US006416197B1

(12) United States Patent
Chang

(10) Patent No.: US 6,416,197 B1
(45) Date of Patent: Jul. 9, 2002

(54) FOUNTAIN WATER LAMP

(76) Inventor: Fu Chang, 4F-1, No. 3-8, Huai-Te St., Taipei (TW)

( * ) Notice: Subject to any disclaimer, the term of this patent is extended or adjusted under 35 U.S.C. 154(b) by 0 days.

(21) Appl. No.: 09/855,500

(22) Filed: May 16, 2001

(51) Int. Cl.[7] ..... F21S 10/00

(52) U.S. Cl. ..... 362/96; 362/101; 362/253; 362/806; 239/20

(58) Field of Search ..... 239/18, 20; 362/96, 362/101, 293, 318, 562, 806, 811, 253

(56) References Cited

U.S. PATENT DOCUMENTS 1,965,323 A * 7/1934 Taslitt ..... 239/20
2,160,474 A * 5/1939 Jones et al. ..... 239/18
2,888,205 A * 5/1959 Trucco ..... 239/20
3,490,694 A * 1/1970 Ashby ..... 239/18
4,901,922 A * 2/1990 Kessener et al. ..... 362/96
6,186,637 B1 * 2/2001 Murrietta ..... 362/101
6,206,298 B1 * 3/2001 Ting ..... 239/20
6,206,536 B1 * 3/2001 Lin ..... 362/101

* cited by examiner

*Primary Examiner*—Alan Cariaso
(74) *Attorney, Agent, or Firm*—Bacon & Thomas, PLLC

(57) ABSTRACT

A fountain water lamp combines a hallucinating water lamp and a landscape fountain. The fountain water lamp consists of a transparent unit, a base, a driving unit, a color disk, a light source unit, a circuit board, a water pump and an air pump. The light source unit generates light to project on the transparent films of the color disk for forming colored light to impart into the transparent unit. The air pump delivers air into the transparent unit to generate air bubbles which are bobbing and scattering in the fluid contained in the transparent unit thereby to produce a hallucinating effect under the projection of the light. The fluid in the transparent unit is driven by the air pump and water pump to overflow into a spill channel and a multi-layer passage and to be drawn by the water pump for returning to the transparent unit again to produce circulation flow thereby to generate the fountain landscape effect

10 Claims, 6 Drawing Sheets

FOUNTAIN WATER LAMP

BACKGROUND OF THE INVENTION

This invention relates to a fountain water lamp and particularly an ornamental fountain water lamp that has fountain landscape and hallucinating decoration effect.

Hallucinating water lamps and landscape fountains are popular decoration goods in many households nowadays. They can produce amusing visual effect and have great appealing.

For instance, a prior art discloses a lighted water globe which has a base including a lamp, a music box, a light altering wheel, and a power supply. Above the base, there is a sealed glass dome filled with water. Inside the glass dome, there are a bundle of fiber optic elements and internal objects such as decorative flowers. When the power supply is activated, the lamp will project light upon the light altering wheel which transforms the receiving light to colorful lights. The colorful lights then are directed to illuminate the fiber optic elements for producing colorful visual effect. When the mechanical music box generate music, a shaft will drive the lighted water globe revolving relative to a support stand. It thus may produce hallucinating and amusing effect.

However aforesaid lighted water globe still has drawbacks. For instance, when the music stop, the water globe also stop revolving. Then the water globe has to be removed from the base, and the bottom of the base has to be turned over for driving the winding key manually to reactivate the music and revolving effect again. It is cumbersome and not convenient.

Moreover, the lighted water globe and the fountain decorative article are individual items. Consumers have to pay more money to buy the hallucinating decoration article and the landscape fountain. As a result, consumers often select to buy only one item.

SUMMARY OF THE INVENTION

In view of aforesaid disadvantages, it is therefore an object of this invention to provide a fountain water lamp that combines a hallucinating water lamp and a landscape fountain to form a complete ornamental set so that after purchasing consumers may have the hallucinating decoration article and the landscape fountain to get a full decorative effect.

Another object of this invention is to save consumer's expenditure.

A further object of this invention to provide an audio-trigger or touch-control circuit board for controlling the water fountain lamp through audio frequency or touch contact means, and the circuit board may generate multiple types of music or broadcast music continuously.

To attain aforesaid objects, the fountain water lamp according to this invention consists of a transparent unit, a base, a driving unit, a color disk, a light source unit, a circuit board, a water pump unit and an air pump unit. When the light source unit generates light and projects on the transparent film of the color disk, colorful light will impart to the transparent unit, and the air pump unit will deliver air into the transparent unit for generating air bubbles which bob and escape in a scattering manner. Under the light projection, the transparent unit will generate hallucinating and amusing effect. The liquid contained in the transparent unit will overflow to a spill channel because of the pumping from the water pump unit and air pump unit, and the fluid will flow from the spill channel to a multi-layer passage to be drawn and pumped again to the transparent unit for continuous circulation thereby to create a fountain landscape effect desired.

The foregoing, as well as additional objects, features and advantages of the present invention will be more readily apparent from the following detailed description, which proceeds with reference to the accompanying drawings.

DESCRIPTION OF THE PREFERRED EMBODIMENTS

Figure 1:
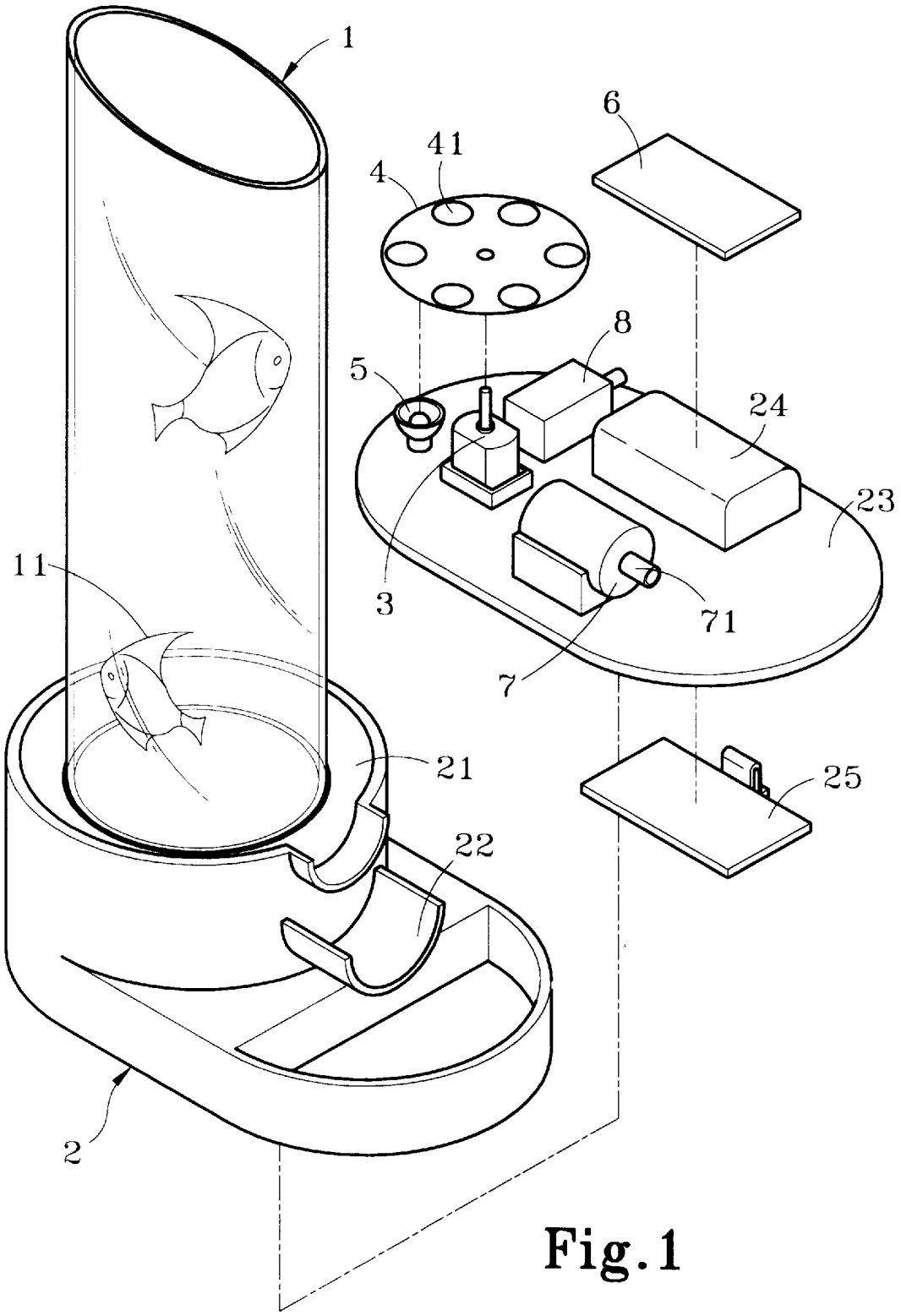
FIG. 1 is an exploded view of this invention.
Figure 2:
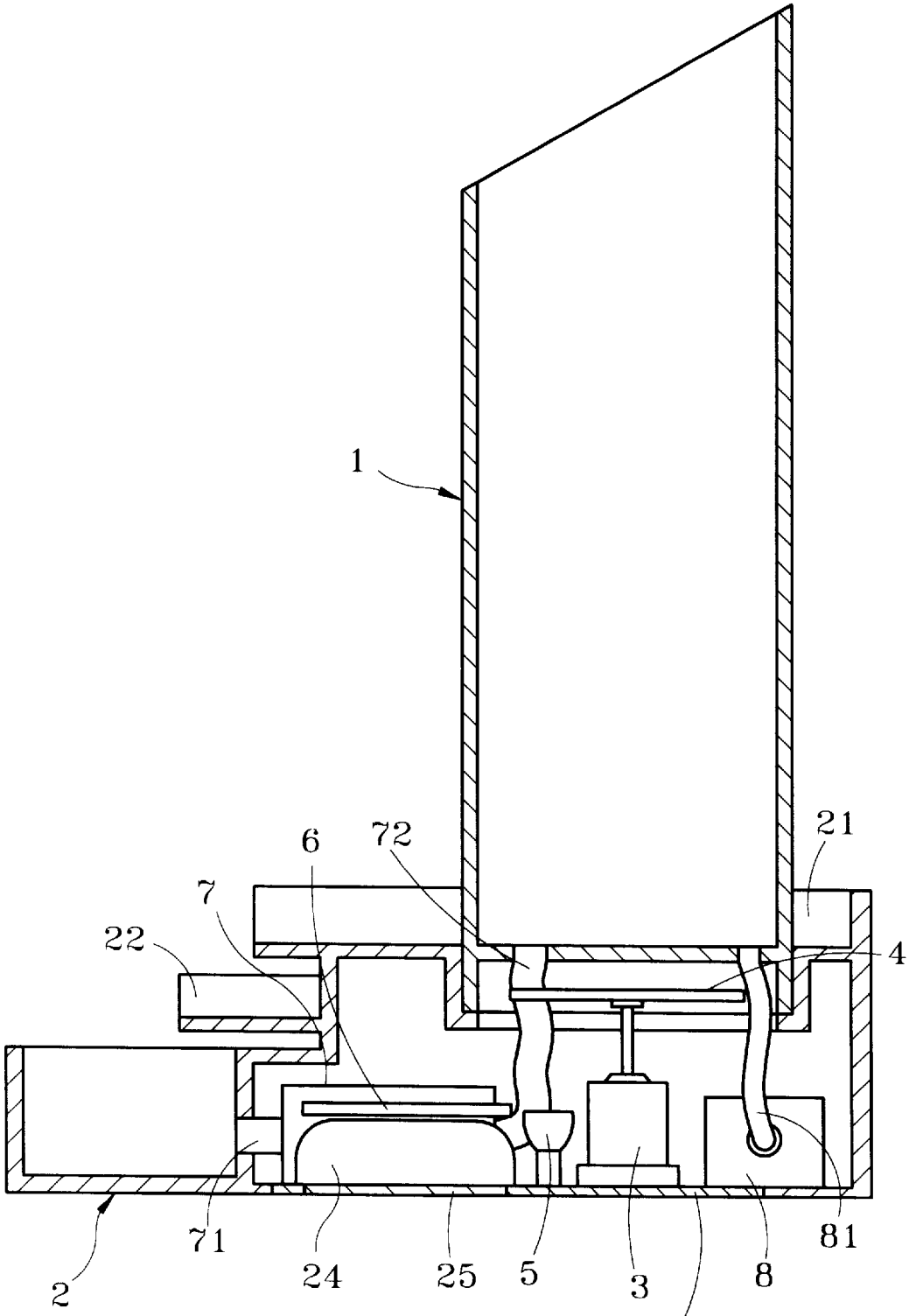
FIG. 2 is a sectional view of this invention according to FIG. 1.
Figure 3:
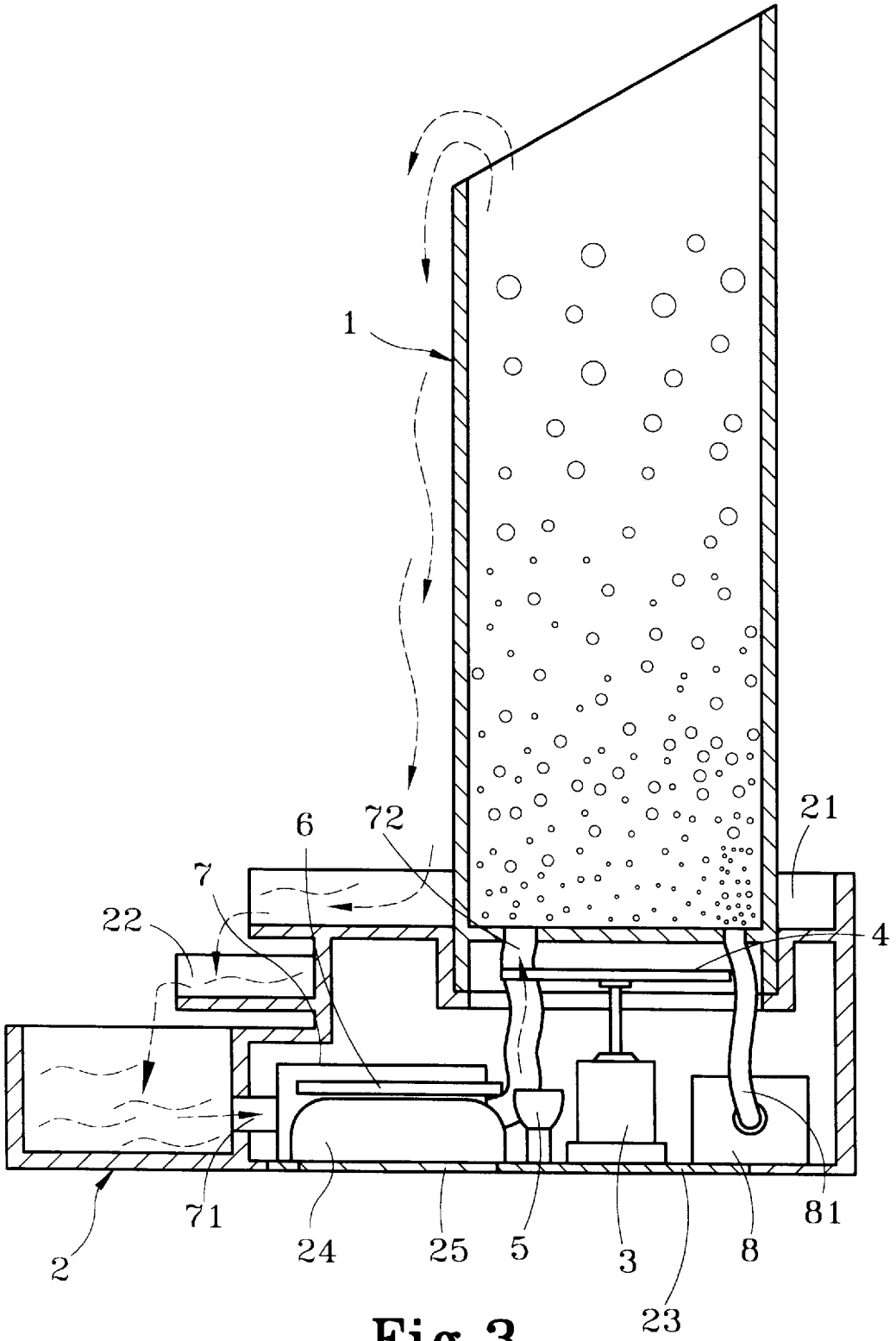
FIG. 3 is a schematic view of the FIG. 2 in action.

Referring to FIGS. 1 and 2, the fountain water lamp according to this invention consists of a transparent unit 1, a base 2, a driving unit 3, a color disk 4, a light source unit 5, a circuit board 6, a water pump 7 and an air pump 8 to generate a mirage-like effect for decorating and amusing purpose.

The transparent unit 1 is a transparent element made of lucid glass or plastics and has a hollow interior for holding liquid and ornamental articles 11 inside. The ornamental articles 11 may be floating in the liquid.

The base 2 is located beneath the transparent unit 1 and has a hollow interior. The base 2 has a solid upper section to engage and support the transparent unit 1 and to form a spill channel 21 around the juncture thereof. The spill channel 21 extends at one end to form a multi-level passage 22. The base 2 further has a base board 23 at the bottom end which has a housing chamber 24 for holding batteries (not shown in the drawings). The housing chamber 24 has an opening engageable with a lid 25 for preventing the batteries from falling off.

The driving unit 3 is located in the base 2 and may be, but not limited to, an AC or DC or step motor.

The color disk 4 engages with the driving unit 3 and has a plurality of color films 41 of different colors disposed thereon. The color disk 4 may be rotated by the driving unit 3 for switching different colors.

The light source unit 5 is located in the base 2 under the color disk 4. When the light source unit 5 generates light and projects upon the color films 41, the light passes through the color films 41 become colored and imparts into the transparent unit 1.

Figure 4:
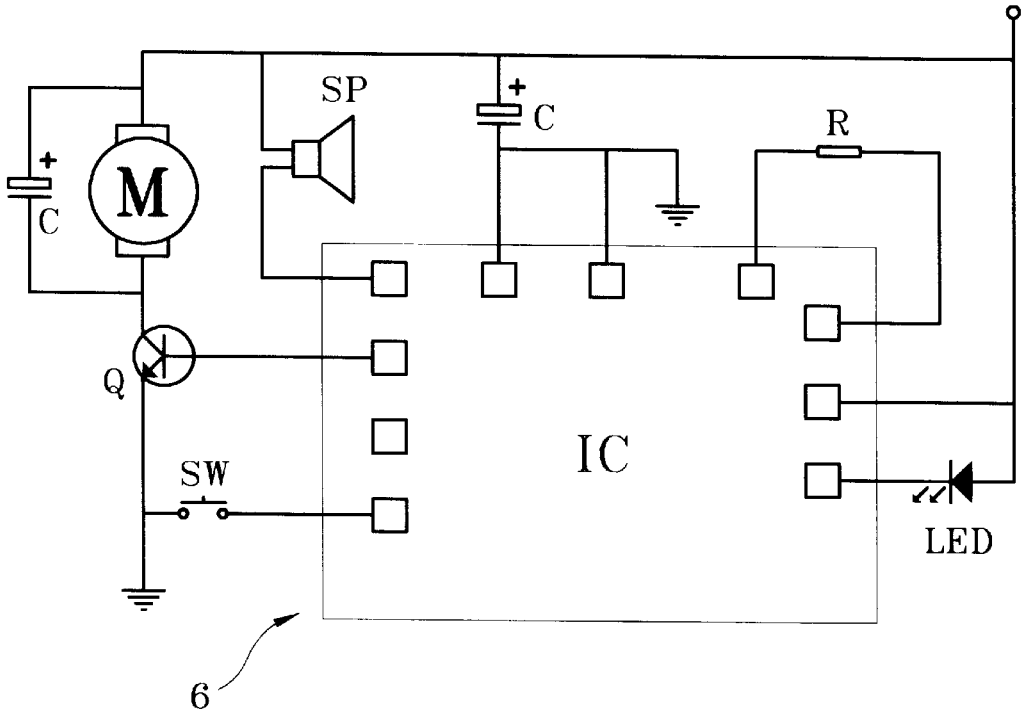
FIG. 4 is an electric circuit diagram for this invention.
Figure 5:
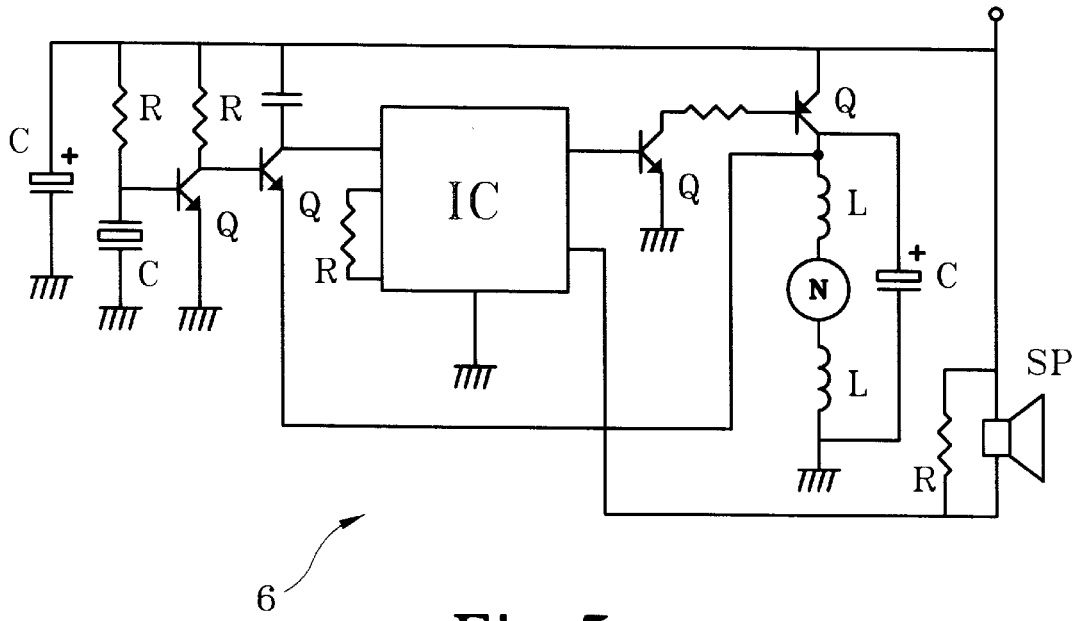
FIG. 5 is another electric circuit diagram for this invention.

The circuit board 6 is located in the base 2 and includes, but not limited to, an audio-trigger or touch-control circuit (as shown in FIGS. 4 and 5). The details of the circuit are known in the art and will be omitted herein. When the fountain water lamp is activated, the audio-trigger or touch-control circuit will broadcast music or songs at a selected sequence.

The water pump 7 is located inside the base 2, and has an input end linked to a first tube 71 which also connects to the passage 22 and an output end linked to a second tube 72 connected to the transparent unit 1. The fluid flows out of the transparent unit 1, passes through the spill channel 21 and passage 22, then is drawn by the water pump 7 and pumped back to the transparent unit 1 again to form a continuous circulation. In the mean time, the flowing fluid drives the ornamental articles 11 floating in the transparent unit 1.

The air pump 8 is located inside the base 2 and has an output end linked to a third pipe 81 connected to the transparent unit 1. The air pump 8 delivers air into the transparent unit 1 for generating air bubbles. Under illumination of the light projecting from the light source unit 5 and nudging by the air bubbles, the ornamental articles 11 will be floating and bobbing to create interesting and amusing effects.

Referring to FIGS. 2 through 5, the circuit board 6 when triggered by audio frequency or touch contact, in addition to broadcasting music or songs, can also activate the light source unit 5, driving unit 3, water pump 7 and air pump 8. Hence light generated by the light source unit 5 will project through the transparent films 41 of the color disk 4 for forming colorful light imparting into the transparent unit 1, the air pump 8 will deliver air into the transparent unit 1 to generate air bubbles in a scattering manner, therefore create a mirage-like effect under Light projection. In the mean time, the fluid in the transparent unit 1 will be driven by the air pump 8 and water pump 7 and overflows to the spill channel 21, and flows to the multi-layer passage 22, then be drawn by the water pump 7 to return again to the transparent unit 1 in a circulation manner thereby to produce a fountain landscape effect.

Moreover, the color disk 4 will rotate when driven by of the driving unit 3 for switching different colors such that the light projecting into the transparent unit 1 will change color too. Coupling the bobbing of the ornamental articles 11 driven by the flowing fluid and scattering air bubbles resulting from the water pump 7 and air pump 8, the constantly moving ornamental articles will also show different colors, thus create a hallucinating and amusing effect.

When the circuit board 6 controls the colorful light change for the ornamental articles 11, the music recorded in the IC of the circuit board 6 will also be amplified and broadcasted through speakers to increase the amusing and entertaining effect.

Figure 6:
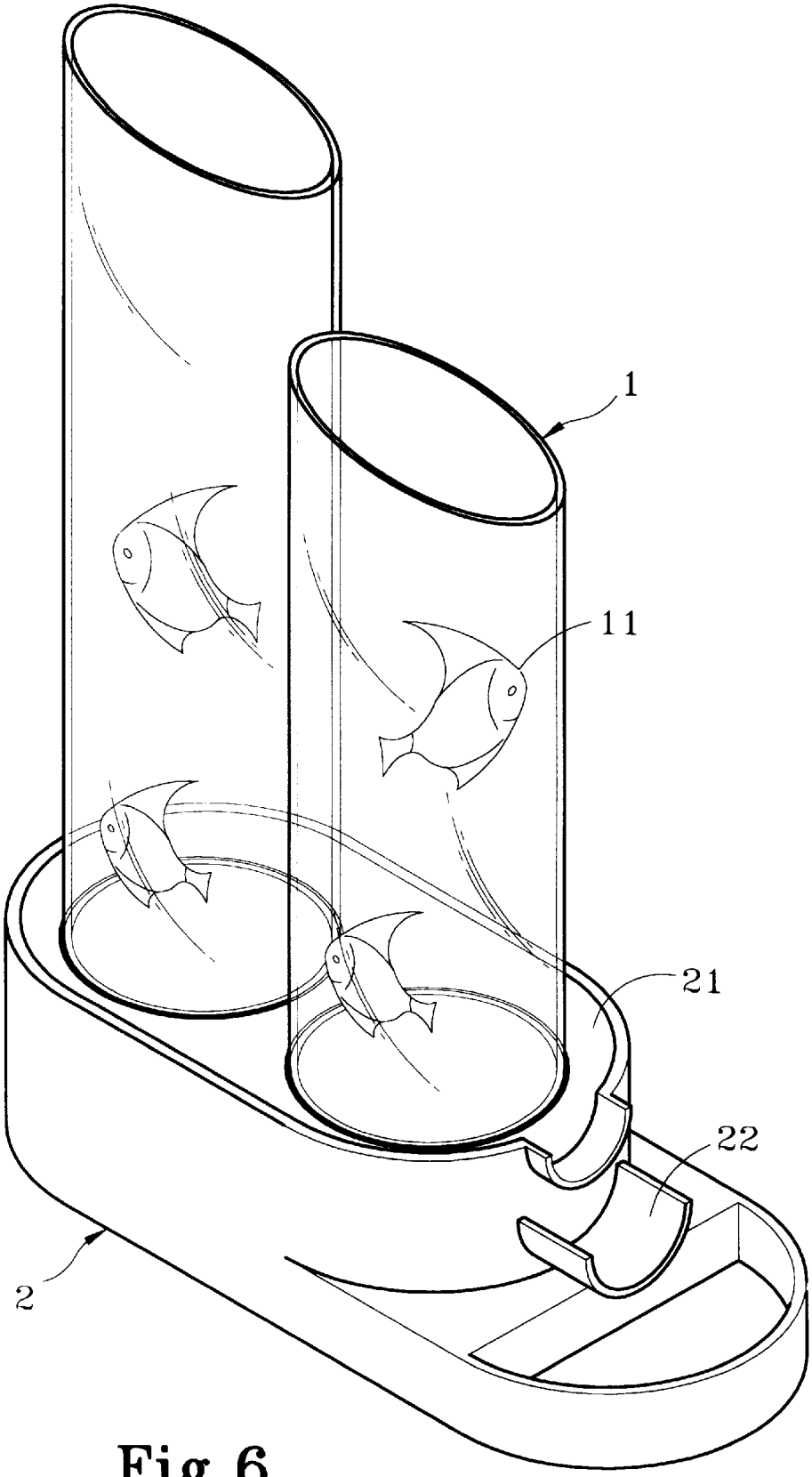
FIG. 6 is a schematic view of another embodiment of this invention.
Figure 7:
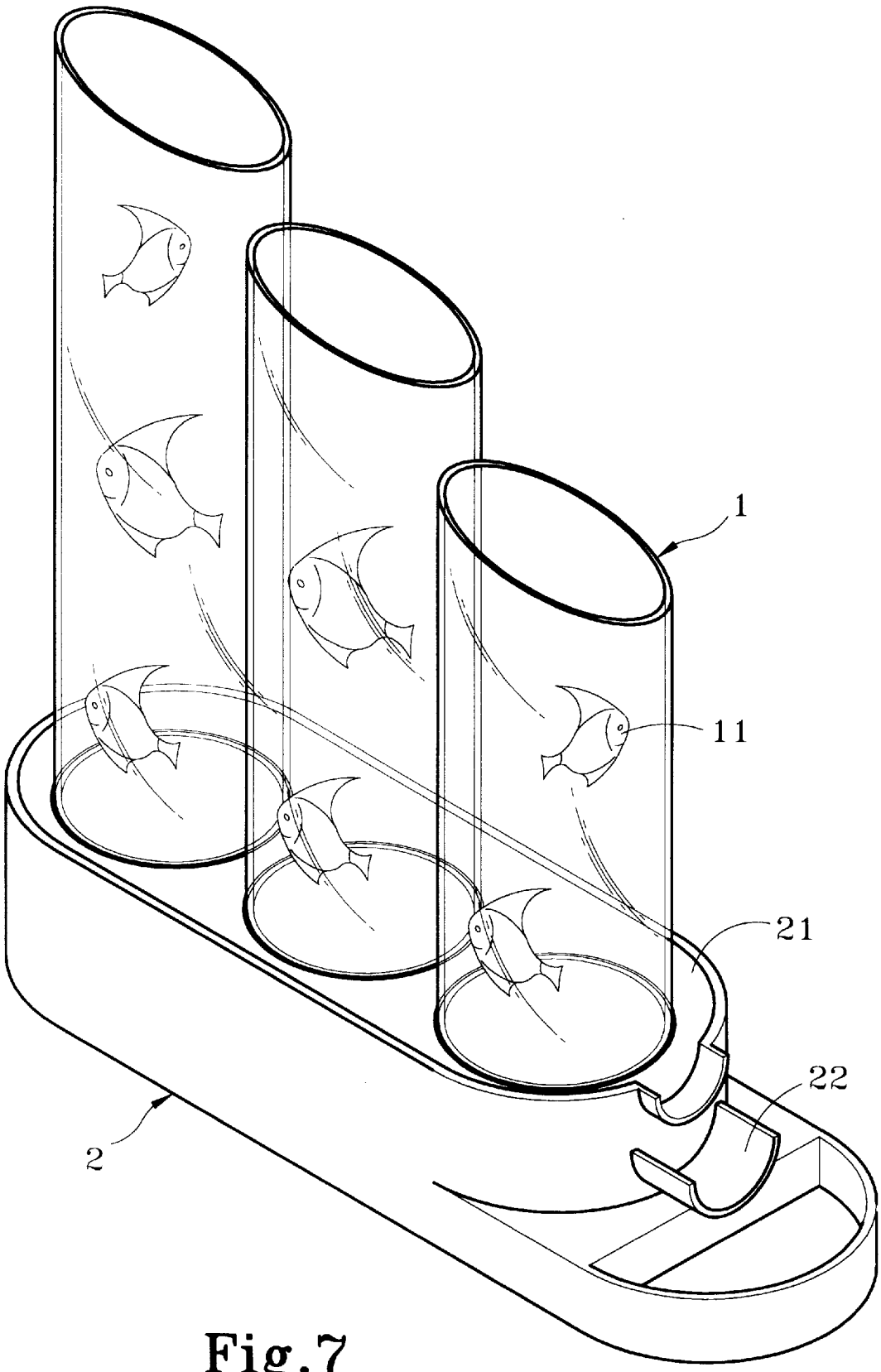
FIG. 7 is a schematic view of yet another embodiment of this invention.

Referring to FIGS. 6 and 7 for another two embodiments of this invention in which one or more transparent unit 1 may be mounted on the base 2 for fluid flowing from an upper location to a lower location, then to be drawn by the water pump 7 to the transparent unit again.

When the transparent units 1 located on the base 2 are separated by a large distance therebetween, each transparent unit 1 may have its own driving unit 3, color disk 4 and light source unit 5. The output end of the air pump may be linked to every transparent unit 1.

When the transparent units 1 located on the base 2 have no or a small distance formed therebetween, they can share the same driving unit 3, color disk 4 and light source unit 5.

What is claimed is:

1. A fountain water lamp, comprising:

a transparent unit;

a base located beneath the transparent unit having a hollow interior and a solid upper section for engaging with the transparent unit at a juncture, the juncture being surrounded by a spill channel which has one side extended to form a multi-layer passage;

a driving unit located inside the base;

a color disk mounted on the driving unit;

a light source unit located in the base below the color disk; and a water pump located in the base having an input end linked to a first tube connecting to the passage and an output end linked to a second tube connecting to the transparent unit;

wherein the light source unit generates light which projects on the color disk to form colorful light to impart into the transparent unit, the transparent unit containing fluid which is driven by the water pump and overflows into the spill channel and through the multi-layer passage to be drawn by the water pump to return the transparent unit for creating circulation and generating a hallucinating and amusing fountain landscape effect.

2. The fountain water lamp according to claim 1, wherein the transparent unit is made of transparent glass or plastics.

3. The fountain water lamp according to claim 1, wherein the transparent unit contains fluid and ornamental articles.

4. The fountain water lamp according to claim 1, wherein the transparent unit has one or more sets.

5. The fountain water lamp according to claim 1, wherein the base has a base board located at the bottom end thereof, the base board having a housing chamber for holding batteries and an opening for engaging with a lid.

6. The fountain water lamp according to claim 1, wherein the driving unit is selectively an AC, a DC or a step motor.

7. The fountain water lamp according to claim 1, wherein the color disk has a plurality of transparent films of different colors located thereon.

8. The fountain water lamp according to claim 1 further having a circuit board.

9. The fountain water lamp according to claim 8, wherein the circuit board is activated by audio frequency or touch contact, and being capable of broadcasting music or songs.

10. The fountain water lamp according to claim 1 further having an air pump for delivering air into the transparent unit to generate air bubbles.

* * * * *